US008911245B2

(12) United States Patent
Okamoto et al.

(10) Patent No.: US 8,911,245 B2
(45) Date of Patent: Dec. 16, 2014

(54) LOW-INSERTION-FORCE CONNECTOR ASSEMBLY

(75) Inventors: Kenichi Okamoto, Makinohara (JP); Ayumu Ishikawa, Makinohara (JP); Sachiko Yagome, Makinohara (JP)

(73) Assignee: Yazaki Corporation, Tokyo (JP)

( * ) Notice: Subject to any disclaimer, the term of this patent is extended or adjusted under 35 U.S.C. 154(b) by 190 days.

(21) Appl. No.: 13/521,542

(22) PCT Filed: Dec. 14, 2010

(86) PCT No.: PCT/JP2010/072460

§ 371 (c)(1),
(2), (4) Date: Jul. 11, 2012

(87) PCT Pub. No.: WO2011/086802

PCT Pub. Date: Jul. 21, 2011

(65) Prior Publication Data

US 2012/0295463 A1 Nov. 22, 2012

(30) Foreign Application Priority Data

Jan. 12, 2010 (JP) ..... 2010-003696
May 10, 2010 (JP) ..... 2010-108084

(51) Int. Cl.
*H01R 13/627* (2006.01)
*H01R 13/629* (2006.01)
*H01R 13/703* (2006.01)
*H01R 13/66* (2006.01)

(52) U.S. Cl.
CPC ..... *H01R 13/62944* (2013.01); *H01R 13/665* (2013.01); *H01R 13/7038* (2013.01); *Y10S 439/9242* (2013.01)
USPC ..... 439/157; 439/364; 439/924.2

(58) Field of Classification Search
USPC ..... 439/157, 362, 364, 372, 924.2
See application file for complete search history.

(56) References Cited

U.S. PATENT DOCUMENTS 5,169,334 A * 12/1992 Makita ..... 439/362
5,295,756 A * 3/1994 Ohta ..... 403/11

(Continued)

FOREIGN PATENT DOCUMENTS

EP 1633022 A1 3/2006
JP 04-085147 A 3/1992

(Continued)

OTHER PUBLICATIONS

International Search Report dated Jan. 18, 2011, issued for PCT/JP2010/072460.

(Continued)

*Primary Examiner* — Neil Abrams
(74) *Attorney, Agent, or Firm* — Edwards Wildman Palmer LLP

(57) ABSTRACT

For connection and disconnection of both connectors with ease and assurance in a narrow work space and connection, and for disconnection of a safety circuit unit without mistakes and in a saved-space, a low-insertion-force connector assembly 53 is provided with one connector receiving the one terminal and other connector 27 receiving a mating terminal, wherein the one connector includes a driving lever 6 having a rotative circular-arc-shaped gear part 13, and, pivotally supported along a wall part 17 of the one connector, a gear wheel part 11 engaged with the gear part, and a gear member 4 having a spiral groove engaged with a driven projection 37 of the other connector, wherein the safety circuit unit 8 is slidably disposed in the one connector, a small connector 38 for connection is disposed in the other connector, thereby the driving lever 6, at a provisional position, prevents the safety circuit unit from rotating in a connecting direction of the safety circuit unit, and, at a connecting position, allows the safety circuit unit to move and is blocked to rotate by a flange 31.

9 Claims, 10 Drawing Sheets

(56) References Cited

U.S. PATENT DOCUMENTS

| | | | | |
|---|---|---|---|---|
| 5,368,496 | A * | 11/1994 | Ranalletta et al. | 439/261 |
| 5,376,016 | A * | 12/1994 | Inaba et al. | 439/364 |
| 5,871,363 | A * | 2/1999 | Kimura | 439/157 |
| 5,913,691 | A * | 6/1999 | Clark et al. | 439/157 |
| 6,044,551 | A * | 4/2000 | Jarrett | 29/868 |
| 6,120,313 | A * | 9/2000 | Luich et al. | 439/362 |
| 6,305,965 | B1 * | 10/2001 | D'Inca | 439/362 |
| 6,325,648 | B1 * | 12/2001 | Bilezikjian et al. | 439/157 |
| 6,648,669 | B1 * | 11/2003 | Kim et al. | 439/357 |
| 6,811,417 | B2 * | 11/2004 | Itoh et al. | 439/157 |
| 6,982,393 | B2 * | 1/2006 | Matsui et al. | 200/335 |
| 7,044,758 | B2 * | 5/2006 | Deno et al. | 439/157 |
| 7,114,969 | B2 * | 10/2006 | Yamada et al. | 439/157 |
| 7,147,504 | B2 * | 12/2006 | Ikeya et al. | 439/364 |
| 7,217,150 | B2 * | 5/2007 | Lekic et al. | 439/352 |
| 7,438,570 | B2 * | 10/2008 | Mori et al. | 439/157 |
| 7,448,887 | B2 * | 11/2008 | Ikeya et al. | 439/157 |
| 7,508,097 | B2 * | 3/2009 | Furuta et al. | 307/328 |
| 7,544,074 | B2 * | 6/2009 | Buck et al. | 439/144 |
| 7,641,499 | B1 * | 1/2010 | George et al. | 439/352 |
| 7,749,016 | B2 * | 7/2010 | Ikeya et al. | 439/364 |
| 7,934,939 | B2 * | 5/2011 | Chen et al. | 439/352 |
| 8,241,052 | B2 * | 8/2012 | Mulot et al. | 439/299 |
| 8,303,320 | B2 * | 11/2012 | Loncar et al. | 439/157 |
| 8,696,373 | B2 * | 4/2014 | Yagome et al. | 439/310 |
| 2005/0221648 | A1 | 10/2005 | Deno et al. | |
| 2007/0134957 | A1 | 6/2007 | Mori et al. | |
| 2012/0295463 | A1 * | 11/2012 | Okamoto et al. | 439/310 |
| 2013/0095683 | A1 * | 4/2013 | Yagome et al. | 439/310 |

FOREIGN PATENT DOCUMENTS

| | | | |
|---|---|---|---|
| JP | 7-41103 | Y2 | 9/1995 |
| JP | 09-219246 | A | 8/1997 |
| JP | 2000-048903 | A | 2/2000 |
| JP | 2003-338344 | A | 11/2003 |
| JP | 2003-346981 | A | 12/2003 |
| JP | 2005-294038 | A | 10/2005 |

OTHER PUBLICATIONS

Office Action dated Oct. 29, 2013, issued for the Chinese patent application No. 201080035938.7 and English translation thereof.

The extended European search report dated Mar. 25, 2014 for corresponding European Patent Application No. 10843157.8.

* cited by examiner

LOW-INSERTION-FORCE CONNECTOR ASSEMBLY

TECHNICAL FIELD

This invention relates to a low-insertion-force connector assembly for engaging and disengaging male and female connectors by rotating a driving lever, as well as for preventing incurrence of spark and the like upon engagement and disengagement.

BACKGROUND ART

FIG. 15 shows one example of a conventional low-insertion-force connector assembly (see Patent Document 1).

The low-insertion-force connector assembly 71 is engaged with other connector (not shown) that is pulled in by rotating a lever 72 in an arrow direction so as to electrically connect with a motor of a hybrid car having an inverter.

The lever 72 is rotatively engaged with an axis on a side of one connector housing 73, and the lever 72 is provided with a cam groove 74 slidably engaging with a driven projection (not shown) of the other connector, wherein by rotating the lever 72 backward as in the arrow direction from standing position, the other connector is pulled in and engaged with the one connector, and wherein by rotating the lever toward standing position, both the connectors are disengaged with each other.

A backward upside of the one connector housing 73 is provided with a slidable sensing member 75 for sensing connection engagement, and the lever 72 is provide with a space 76 accommodating the sensing member 75 and a rocking hole 78 engaging with a projection 77 of an arm of the sensing member 75, wherein by projecting the sensing member 75 backward slidably upon complete engagement of both the connectors, the complete engagement of both the connectors is sensed, the projection 77 of the arm is engaged with the rocking hole 78, and the sensing member 75 is thus rocked.

There is described in, e.g., Patent Document 2 another example as a conventional low-insertion-force connector assembly other than the one mentioned above in which a cam bolt having a spiral groove is inserted into the one connector housing, a projection of other connector is inserted into the spiral groove, and by rotating the cam bolt with an operation handle, both connectors are engaged or disengaged with each other.

PRIOR ART DOCUMENT

Patent Document

Patent Document 1: JP, A, 2005-294,038 (FIG. 4)
Patent Document 1: JP, UM, B, 7-41,103 (FIG. 1)

DISCLOSURE OF THE INVENTION

Problem to be Solved by the Invention

However, for above conventional low-insertion-force connector assembly, a space for work for rotating the lever 72 or the handle in engaging or disengaging with both the connectors, and a space for mounting the handle on the cam bolt are required, resulting in difficulty of smoothly engaging and disengaging with the connectors in such a narrow automobile space as a hybrid car. Further, when connecting or disconnecting in an automobile maintenance a motor with an inverter mounted on the hybrid car as a device, it is required to provide a safety circuit to keep an operator away from risk such as shock, requiring unmistaken work in connection or disconnection of the safety circuit even in a narrow space.

Accordingly, an object of the present invention, in light of the above, is to provide a low-insertion-force connector assembly for allowing both the connectors to easily, reliably engage or disengage with each other in a narrow work space, in addition, to reliably operate connection or disconnection of the safety circuit there.

Means for Solving the Problem

For attaining the object, according to the invention described in claim 1, there is provided a low-insertion-force connector assembly comprising one connector receiving one terminal, and other connector receiving a mating terminal, the one connector including a driving lever having a gear part arranged in the circular-arc shape, the driving lever rotatively arranged along a wall portion of the one connector and pivotally supported onto the wall portion, a gear wheel engaging with the gear part, and a gear member having a spiral groove engaged with a driven projection of the other connector.

According to the above configuration, rotating the driving lever in one direction along the wall portion (a wall face) of the one connector (one connector housing) allows the gear part to rotate the gear member via the gear wheel such that the driven projection of the other connector is pulled in along the spiral groove in the engagement direction to connect with each other. Rotating the driving lever along the wall portion in a reverse direction allows the gear member to rotate reversely such that the driven projection of the other connector moves in a disconnecting direction to disconnect with each other. The driving lever can rotatively be driven on one two-dimensional plane along the wall portion for saving space.

According to the invention described in claim 2, there is provided a low-insertion-force connector assembly claimed in claim 1, wherein the driving lever comprises a circular-arc-shaped wall having the gear part, a pivotally-supported middle wall, and an operation part.

According to the above configuration, the circular-arc-shaped wall, the middle wall and the operation part are arranged on about the same plane as to make a driving lever flat.

According to the invention described in claim 3, there is provided a low-insertion-force connector assembly claimed in claim 1 or 2, wherein the one connector is provided with a safety circuit unit slidable in an axial direction of the driving lever, wherein the other connector is provided with a small connector for mating with the safety circuit unit, the driving lever is prevented the safety circuit unit from moving in a mating direction at a provisional connection engagement position, and the driving lever permits the safety circuit unit to move in the mating direction and being prevented from rotating by a flange of the safety circuit unit at a connection engagement position.

According to the above configuration, for example, lifting the safety circuit unit to disconnect with the small connector slidably and rotating the driving lever in one direction with the flange higher than the driving lever so as to connect both the connectors to each other, and slidably descending the safety circuit unit so as to connect with the small connector permits the safety circuit unit (sub circuit) to connect with the small connector so as to energize a switch, e.g., a relay, energizing each terminal of both the connectors. The flange abuts an end of the driving lever to prevent rotation during energization so as to block unexpectedly disconnection. Lifting the safety circuit unit to disconnect with the small connector allows a main circuit to be cut off, and then rotating the driving lever in the other direction permits both the connectors to disconnect safely without such sparks.

According to the invention described in claim 4, there is provided a low-insertion-force connector assembly claimed in claim 1 or 2, wherein the one connector is provided with the safety circuit unit slidable in an axial direction perpendicular to the driving lever, the other connector is provided with a small connector for mating with the safety circuit unit, the driving lever includes a groove engaging with a boss of the safety circuit unit, and wherein in a condition of disconnection between the safety circuit unit and the small connector the boss approaches and engages with the groove by rotating the driving lever, and wherein in a condition of connection between the safety circuit unit and the small connector in which the boss approaches and engages with the groove, the groove corresponds to a sliding direction, and the safety circuit unit is allowed to connect with the small connector.

According to the above configuration, rotating the driving lever in a connecting direction in a state of the safety circuit unit being away from the small connector allows the boss of the safety circuit unit to approach slidably and engage with the groove of the driving lever, connecting both the connectors with each other. From this state moving the safety circuit unit toward the small connector slidably allows the boss to move together along the groove (the boss remains within the groove), then the safety circuit unit is connected with the small connector to energize the safety circuit unit, and the main circuits of both the connectors are thus energized. Even if the driving lever is intended to rotate in the reverse direction, i.e., the direction to disconnect, the driving lever in this state cannot be rotated because of the boss engaging with the groove, which secures safety during energization of the main circuit. When disconnecting, the safety circuit unit is disconnected from the small connector so as to be cut off, the driving lever is then rotated in a disconnecting direction with the main circuit being shut down.

According to the invention described in claim 5, there is provided a low-insertion-force connector assembly claimed in claim 4, wherein the boss of the safety circuit unit separated from the small connector abuts a side where the groove of the driving lever is formed such that rotation of the driving lever is prevented in an engaging direction of both connectors.

According to the above configuration, in case that the safety circuit unit is provisionally connected with the small connector, i.e., the main circuit is energized, attempting to rotate the driving lever in the connecting direction results in failure of further rotation of the driving lever because of the boss abutting a side of the driving lever, preventing incurrence of such sparks upon connection. The operator again rotates the driving lever in a state that the safety circuit unit is disconnected from the small connector and the safety circuit is cut off, i.e., the main circuit is cut off.

Effects of the Invention

According to the invention described in claim 1, since the driving lever is rotatively driven on two-dimensional plane along the wall portion for saving space, smooth disconnection of both the connectors is secured in such a narrow space as a vehicle. It is made possible that utilizing the driving lever rotatively arranged along the wall portion and the gear member having gear wheel and the spiral groove also downsize the low-insertion-force connector assembly, and engagement between the gear member and gear wheel secures to rotate the gear member to connect or disconnect.

According to the invention described in claim 2, making the driving lever flat-shaped allows a space for rotation and operation thereof to decrease, improving space-saving and downsizing.

According to the invention described in claim 3, the flange of the safety circuit unit prevents the driving lever to unintentionally rotate to disconnect when connecting, and allows both the connectors to safely and securely disconnect by rotating the driving lever without spark or shock thereby in saved space in a state that the safety circuit unit and the small circuit are disconnected and the main circuit is cut off before disconnection. Also preventing the safety unit from moving in a connecting direction by the driving lever in provisionally connection and allowing the safety circuit unit to move in the connecting direction in connection enable the safety circuit unit to be secured to connect or disconnect, and furthermore, allowing the safety circuit unit to be manually and slidably connected or disconnected with the small connector enables connection or disconnection of the safety circuit unit to be operated in a saved space.

According to the invention described in claim 4, while connecting the both connectors to connect the safety circuit unit with the small connector by rotating the driving lever, moving the boss along the groove of the driving lever, and preventing the driving lever from rotating as well in a disconnecting direction of both the connectors by engagement of the boss and the groove can prohibit unintentional disconnection of both the connectors and improve security. Further, moving the boss in a reverse direction along the groove allows the safety circuit unit to be cut off with the both connectors being connected, and rotating the driving lever in a reverse direction allows both the connectors to disconnect. Guiding the boss of the safety circuit unit along the groove of the driving lever with both the connectors being connected while connecting and disconnecting the safety circuit unit and the small connector to each other also allows the safety circuit unit to securely be connected or disconnected, and further allowing the safety circuit unit to be manually and slidably connected or disconnected with the small connector enables operation for connection or disconnection of the safety circuit unit to perform in a saved space.

According to the invention described in claim 5, if the safety circuit unit is powered on in provisional connection of both the connectors (the main circuit is powered on), preventing rotation of the driving lever to block connection of both the connectors avoids generation of sparks, thus improving security.

DESCRIPTION OF EMBODIMENTS

Figure 1:
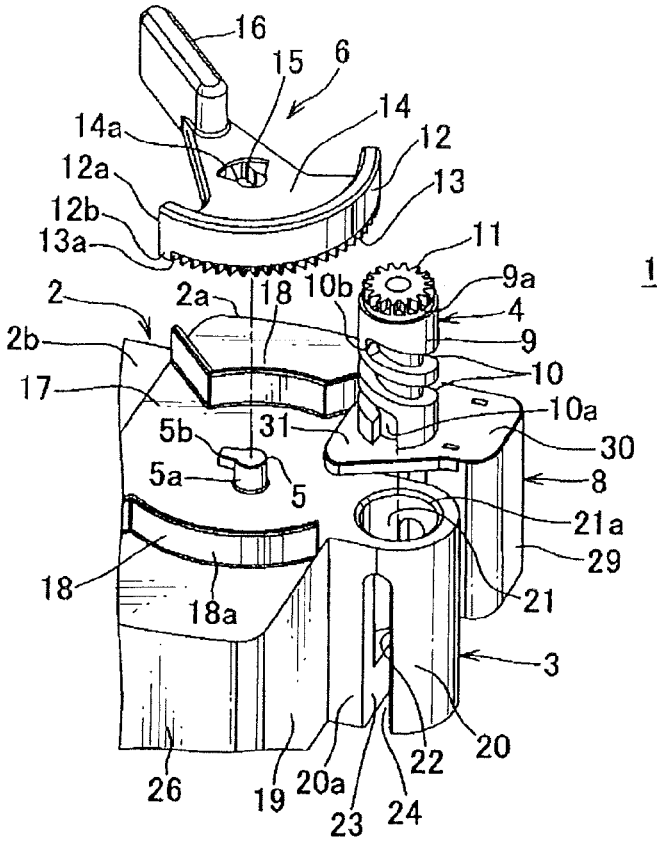
FIG. 1 is an exploded perspective view illustrating a first embodiment of one connector configuring a low-insertion-force connector assembly according to the present invention.
Figure 2:
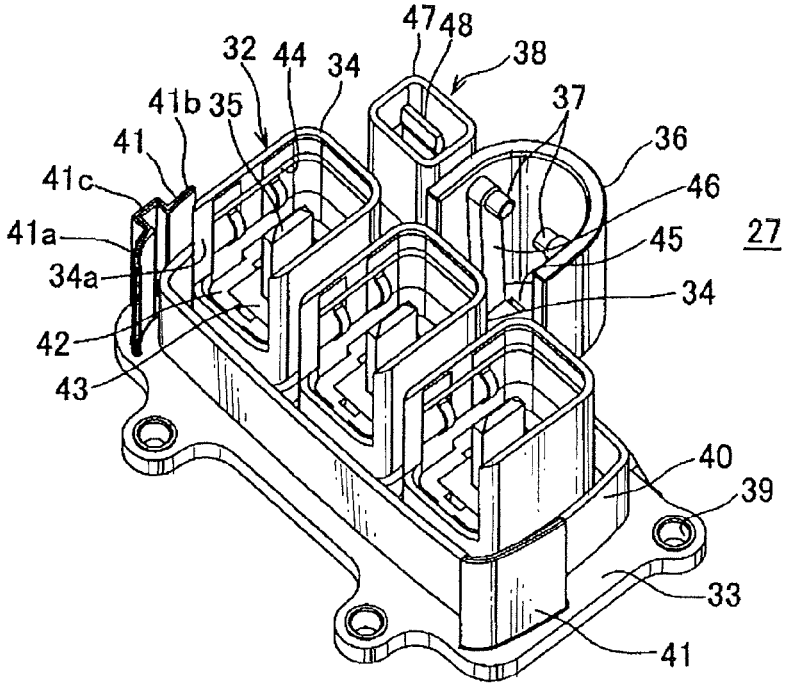
FIG. 2 is an exploded perspective view illustrating the other connector configuring the low-insertion-force connector assembly according to the first embodiment of the present invention.

FIGS. 1 to 2 illustrate a first embodiment of a low-insertion-force connector assembly according to the present invention. FIG. 1 illustrates one connector receiving female terminals (female connector), and FIG. 2 illustrates other connector receiving male terminals (male connector), both of which configure a low-insertion-force connector assembly.

As shown in FIG. 1, the one connector 1 is provided with one connector housing 2 made of insulating resin, L-shaped female terminals (not shown) with electric wire accommodated in the one connector housing 2, a columnar gear member 4 made of synthetic resin mounted in a tubular housing 3 of the one connector housing 2, a driving lever 6 made of synthetic resin rotatively engaging with an axis 5 of the one connector housing 2 while engaging with the gear member 4, and a safety circuit unit slidably engaging with a rail part 7 (FIG. 4) of the one connector housing 2 and slidably movable in response to the position of the driving lever 6.

Figure 3:
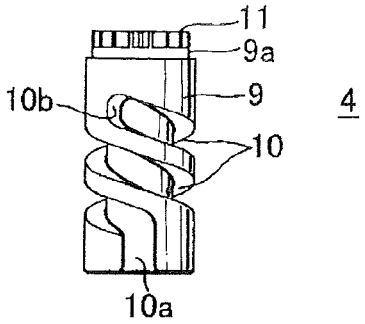
FIG. 3 is a side view illustrating one embodiment of a gear member of the one connector.

As shown in FIGS. 1 and 3, the gear member 4 is composed of a columnar part 9, a spiral groove 10 disposed outside of the columnar part 9, and a gear wheel part (a pinion) 11 with circular circumference integrally disposed on a top of the columnar part 9, one end of the spiral groove 10 follows a inlet 10*a* open to a lower end of the columnar part 9 and vertically short in a axial direction, and the other end 10*b* of the spiral groove 10 is disposed near a lower side of the gear wheel 11. The gear wheel 11 is formed smaller than the outer diameter of the columnar 9 and follows the columnar 9 via a short seat 9*a* with the same diameter of the gear wheel 11.

Figure 4:
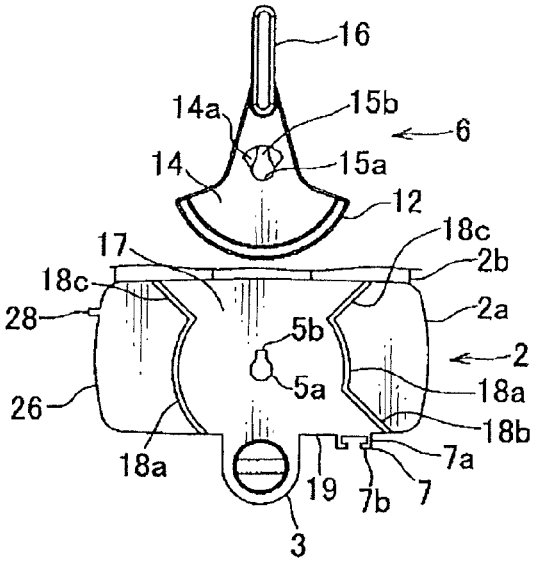
FIG. 4 is a plan view illustrating the one connector and a driving lever thereof.

As shown in FIGS. 1 and 4, the driving lever 6 is composed of a circular-arc wall part 12, a circular-arc outer gear part (a circular-arc rack) 13 engaging with a gear wheel 11 of the gear member 4, a fan-shaped horizontal middle wall part 14 following an inside of the circular-arc wall part 12, a bearing hole 15 disposed in the middle wall part 14, and an operation wall part 16 following an end of the middle wall part 14.

A side end 13*a* of the gear part 13 is disposed circumferentially more inlaying than a side end 12*a* of the circular-arc wall part 12, (i.e., terminated inwardly), and between the side end 13*a* of the gear part 13 of the circular-arc wall part 12 and the side end 12*a* of the circular-arc wall part 12 a stopper wall part 12*b* exists. The circular-arc wall part 12 and the operation wall part 16 are disposed higher than the middle wall part 14, projecting upward. The bearing hole 15 is composed of a circular hole 15*a* (FIG. 4) a main body 5*a* of an axis part 5 passes through, and a rectangle hole 15*b* a projection 5*b* passes through. On a top surface of the middle wall part 14 in a side of the rectangle hole 15*b* is formed a fan-shaped shallow groove 14*a*. Each lower end of wall parts 12, 14 and 16 abuts an upper wall (wall part) 17 of the one connector housing 2.

The circular-arc wall part 12 is formed with the angle less than 180-degree. A rotation degree range of the driving lever 6 in this embodiment is set 90-degree, that of the gear member 4 360-degree, which gear diameter and number of teeth of the gear part 13 and gear wheel 11 is set to fit.

As shown in FIGS. 1 and 4, the one connector housing 2 is provided with a rectangle part 2*a* and tubelar part 2*b* integrally following an end of the rectangle part 2*a*, on a top wall 17 of the rectangle part 2*a* the axis part 5 and a lever guide wall 18 are disposed, and a generally tubelar housing 3 accommodating the gear member 4 and a rail part 7 (FIG. 4) engaged vertically slidable with the safety circuit unit 8 are adjacently, in parallel disposed in a front wall 19 of the rectangle part 2*a* integrally.

The axis part 5 is composed of the short tubelar main body 5*a* as mentioned above and a pressure projection 5*b* vertically projecting backward the axis main body 5*a*. The lever guide wall 18 is composed of a circular-arc parts 18*a* of both sides and each of straight slope parts 18*b*, 18*c* (FIG. 4) following a fore-and-aft end of the left circular-arc part 18*a* and aft end of the right circular-arc part 18*a*. The housing 3 is arranged in the middle of a front end of the rectangle part 2*a* in a width direction, having a side wall 20 composed of a sectional-semicircular part and a straight wall, wherein the straight wall 20*a* is perpendicular to the front wall 19 of the one connector housing 2, having a sectional-circular perforated housing 21 inside the side wall 20, and a pair of vertical guide slit 22 at both sides of the side wall 20, a lower end of the pair of guide slits 22 communicates with a horizontal slit 24 of the bottom wall 23 of the side wall 20, and a upper end of the guide slit 22 is located near a lower side of an upper end of the side wall 20.

As shown in FIG. 4, the rail part 7 of the front wall 19 of the one connector housing 2 is composed of a pair of sectional-L-shaped rail walls of both sides, each of which is composed of a part 7*a* perpendicular to the front wall 19 and a part 7*b* parallel to the front wall 19. Inside the rail part 7 a sectional-T-shaped engaging rail part 25 (FIGS. 6A, 6B) of the safety circuit unit 8 is slidably engaged. The rail part 7 and the engaging rail part 25 configure a sliding structure.

Further, near a backside of the right wall 26 of the one connector housing 2 a vertical guide lib 28 (FIG. 4) is disposed corresponding to the other connector 27 shown in FIG. 2. It is noted that direction herein of up, down, front, back, right and left is expediential for explanation, attachment directions of the one connector 1 and 27 are not limited to the same.

Figure 5:
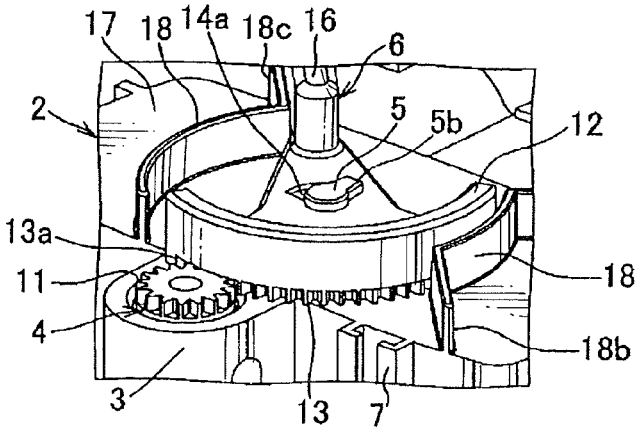
FIG. 5 is a perspective view illustrating an engagement of the driving lever and the gear member.

As shown in FIG. 5, the gear member 4 is inserted in an axial direction into the housing 3 of the one connector housing 2 from an upper opening 21*a*, exposing (protruding) the gear wheel 11 of an upper end of the gear member 4 upward the housing 3.

Then while the axis part 5 is inserted into the bearing hole 15 of the driving lever 6, the gear part 13 of the driving lever 6 is engaged with the gear wheel 11 of the gear member 4. I.e., an upper face of the gear wheel 11 of the gear member 4 abuts an lower face (an upper face of the gear part 13) of the circular-arc wall 12 of the driving lever 6, which prevents the gear member 4 to come loose upward, and the lower face of the gear member 4 abuts an upper face of the bottom wall 23 of the housing 3 to be supported.

As shown in FIG. 5, the gear wheel 11 of the gear member 4 is stopped by a right end 13*a* and a left end 13*b* of the gear part 13 of the driving lever 6. The projection 5*b* of the axis part 5 slidably, relatively move along the shallow groove 14*a* (the axis 5 is integrally fixed to the one connector housing 2). The circular-arc wall part 12 of the driving lever 6 rotates along an inside of the circular-arc guide wall 18, and the operation wall part 16 abuts the backward slope wall part 18*c*, preventing the driving lever 6 from rotating further. An upper end of the rail part 7 and an upper end of the one connector housing 2 is positioned the same face of an upper wall 17 (upper face) of the one connector housing 2.

As shown in FIG. 1, the safety circuit unit 8 is composed of a nearly rectangle-shaped case 29 made of isolating resin, a vertical engagement rail part 25 (FIGS. 6A, 6B) formed T-shaped in section projecting outward the case 29, and an inverted U-shaped short terminal (not shown) accommodated in the case 29. The case 29 is composed of a vertical side wall (substituted by symbol 29) and a horizontal ceiling wall 30, wherein the engagement rail part 25 is disposed on a back wall part of the side wall 29, the ceiling wall 30 is formed flange-shaped and is projected backward further than the side wall 29, the engagement rail part 25 is slidably engaged with the rail part 7 of the one connector housing 2, a lower face of the flange part 31 of the one connector housing 2 is capable of abutting an upper face of the upper wall 17 of the one connector housing 2 at a position of sliding lower end, and the flange 31 is capable of projecting upward further than the driving lever 6 at a position of sliding upper end.

As shown in FIG. 2, the other connector 27 is composed of one connector housing 32 made of isolating resin, a plurality of parallel housing walls 34 (three walls in the present embodiment) standing upward from a flange wall 33 of a lower end of the one connector housing 32, each of metallic male terminals 35 each accommodated in the housing walls 34, a guide side wall 36 adjacently standing on the horizontal flange wall 33 outward and frontward the housing walls 34, a pair of right and left driven projections 37 disposed inside the guide side wall 36, a small connector 38 (sub connector) standing on the flange wall 33 parallel to the guide side wall 36 to be connected with the safety circuit unit.

The flange wall 33 is formed nearly-rectangle, on which outside a bolt-inserting through bore 39 to be fixed to a device (a motor or an inverter) is disposed, on which inside nearly-rectangle low side wall 40 stands, each of housing walls 34 stands high inside the side wall 40, on both sides of the flange wall 33 near back end between an outside of the flange wall 34 and the side wall 40, a pair of right and left plate-like guide walls 41 corresponding to the one connector housing 2 stands higher than the side wall 40, and the guide side wall 36 and the small connector housing 38 are coupled to a front end side of the flange wall 33.

Inside the side wall 40 the flange wall 33 also extends to form a bottom wall of the each housing wall 34, in the bottom wall a hole part (not shown) is disposed, from which a tab-shaped male terminal 35 is inserted into the housing wall 34, within a low frame wall 42 on a base side of the male terminal 35 a waterproof packing 43 is mounted, from a gap between the frame wall 34 and the housing wall 34 an conductive metal shield shell 44 is disposed along inside the housing wall 34, and the housing wall 34 is provided with a backward cutout opening 34*a*, surrounded by three-side wall parts.

The side wall 40 is inserted along inside the side wall 19, 26 of the rectangle part 2*a* of the one connector 1 (see FIGS. 7A, 7B), and the guide wall 41 is positioned along outside the side wall 19, 26 of the rectangle part 2*a*. The backward guide wall 41 prevents the front guide side wall 36 and the housing 3 from falling in slidable engagement. Each of the guide wall 41 is composed of a backward bent part 41*a* and a frontward straight part 41*b*, and the right guide wall 41 is composed of a vertical concave groove 41*c* into which a rib 28 (FIG. 4) of the other connector housing 2 is inserted (in FIG. 2 the right and the left guide wall 41 is inversely illustrated).

The guide side wall 36 is disposed opposite to a front middle portion of the side wall 40, i.e., the middle housing wall 34, composed of a frontward part shaped semicircle in section and a backward straight part corresponding to the housing 4 of the other connector housing 3, and coupled to the flange 33 on the horizontal bottom wall 45. Inside the guide side wall 36 a pair of vertical right and left ribs 46 and vertical short columnar driven projections 37 projecting inwardly from a top end of the rib 46 are disposed. The rib 46 is slidably engaged with a slit 22 of the housing 3 of the one connector 1, and the driven projections 37 projects inside the housing 3, slidably engaged with the spiral groove 10 of the gear member 4.

The small connector 38 is composed of a rectangle small connector housing 47 and a pair of right and left small terminals (not shown) disposed along the printed wiring board 48 in the small connector housing 47, and a waterproof packing 49 (FIGS. 7A, 7B) attached to a lower outside of the small connector housing 47 and closely-attached to the devise. Each small terminal is connected with each electric wire 50 (FIGS. 7A, 7B), which each electric wire 50 is connected with a switch (not shown), e.g., a relay, of the device.

Figure 6A:
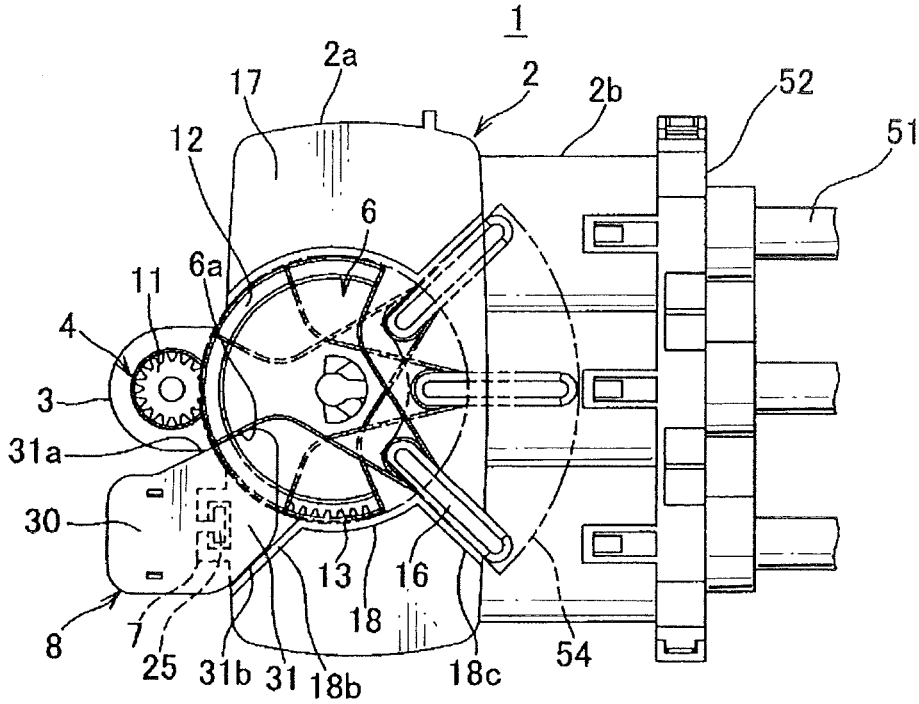
FIG. 6A is a plan view illustrating an operation range of the driving lever in the one connector.
Figure 6B:
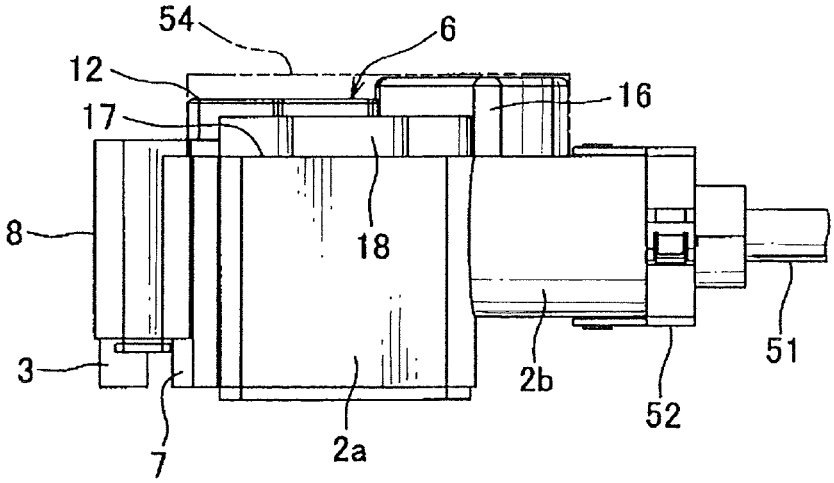
FIG. 6B is a side view illustrating the operation range of the driving lever in the one connector.

As shown in FIGS. 6A, 6B, along the upper wall 17 of the rectangle part 2*a* of the one connector housing 2, the driving lever 6 is horizontally, rotatively disposed within the range of 90°, and the gear part 13 of the driving lever 6 rotates within the range of 360° the gear wheel 11 of the gear member 4. The range of rotation of the driving lever 6 or the gear wheel 11 may appropriately be set. A chained line shown by symbol 54 in FIGS. 76, 6B shows the range of the driving lever 6 rotating (an operation space).

When the driving lever 6 is clockwise rotated as shown by solid line, a front left side 6*a* is opposed to a right side of the a sloped periphery 31*a* of the flange 31 of the ceiling wall 30 of the descending safety circuit unit 8 with some clearance, and the operation part 16 of the driving lever 6 abuts the backward sloped periphery 18*c* of the left guide wall 18. A left sloped periphery 31*b* of the flange 31 abuts a frontward sloped periphery 18*b* of the left guide wall 18. When the driving lever 6 is counterclockwise rotated as shown by the chained line, the safety circuit unit 8 is ascended to position (evacuate) the flange 31 upward the driving lever 6. Each of backward sloped peripheries 18*c* of the right and left guide wall 18 functions as a stopper for the operation part 16.

The operation part 16 of the driving lever 6 at the middle rotation position is positioned middle upward a backward tubelar part 2*b*. In the tubular part 2*b* an L-shaped female terminal (not shown) of electric connection part (a crimp part) is accommodated, a waterproof rubber plug (not shown) the electric wire 51 is inserted into is retained by a synthetic resin rear holder 52 attached to the tubular part 2*b*. In the tubular part 2*a* of the one connector housing 2 an electric contact of female terminal is accommodated in a downward direction, and along inside the tubular part 2*a* a conductive metal shield shell (not shown) is mounted to being connected with a braid (not shown) of the electric wire 51 (shield wire).The electric wire 51 is pulled out (guided) outward from backward the one connector housing 2 in a perpendicular direction of the connecting (or disconnecting) engagement direction along the horizontal tubular part 2*b*. The driving lever 6 is horizontally disposed in the same direction of the electric wire 51 being pulled out to horizontally rotate.

Figure 7A:
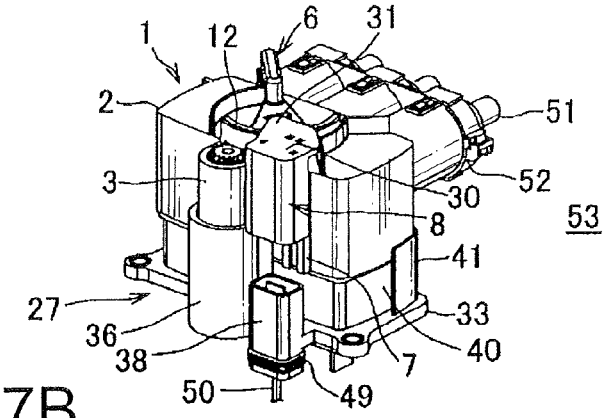
FIG. 7A is a perspective view illustrating a provisional engagement of both the connectors.
Figure 7B:
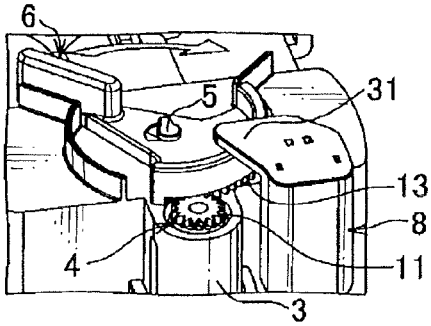
FIG. 7B is a main part perspective view illustrating the provisional engagement of both the connectors.

As shown in FIGS. 7A and 7B, when the one connector 1 is connected with the other connector 27, the driving lever 6 is counterclockwise rotated to be positioned at the rotating start end, the safety circuit unit 8 is ascended along the rail part 7, and the flange 31 of the ceiling wall 30 is then positioned upward the circular-arc wall 12 of the driving lever 6. In this state, engaging the other connector 27 with the one connector 1 provisionally (initially) allows the gear member housing 3 to be initially inserted into the guide side wall 36, guiding the driven projection 37 (FIG. 2) in the guide side wall 36*a* to the spiral groove 10 from an inlet part 10*a* of a lower end of the gear member 4 (FIG. 1).

The safety circuit unit 8 is not yet connected with the small connector 38, opening the safety circuit (sub circuit), de-energizing the switch such as a relay (not shown), the male and female terminals (main circuit) of both the one connector 1 and the other connector 27 are thus not supplied with current, which permits the operator to safely operate connector engagement.

Figure 8A:
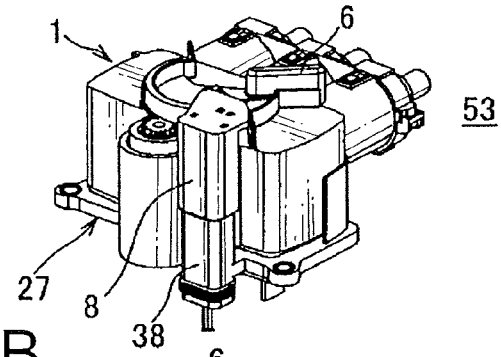
FIG. 8A is a perspective view illustrating an engagement of both the connectors (a condition of an electrical disconnection)
Figure 8B:
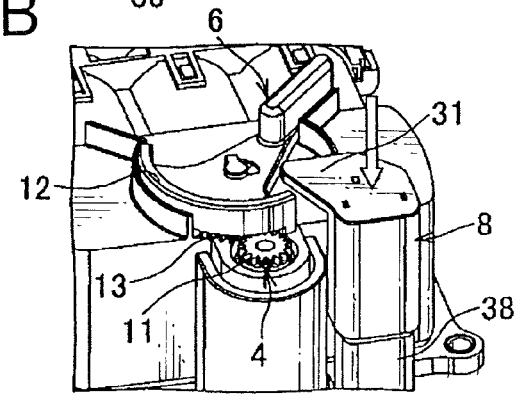
FIG. 8B is a main part perspective view illustrating the engagement of both the connectors.

As shown in FIGS. 8A and 8B, rotating the driving lever 6 clockwise allows the gear member 4 to rotate counterclockwise, the driven projection 37 (FIG. 2) to rise along the spiral groove 10 (FIG. 1), thus the other connector 27 is connected with the one connector 1, and the male and female terminals (main terminals) are connected to each other. The low-insertion-force connector assembly is composed of both the connectors 1 and 27. At the position of rotation end for the driving lever 6 shown in FIGS. 8A, 8B, the circular-arc wall part 12 of the driving lever 6 is separated from the flange 31 of the safety circuit unit 8 slightly rightward, the safety unit 8 is the same ascent position as shown in FIGS. 7A, 7B, and the small connector 38 is positioned in disconnection with the safety circuit unit 8 with a slight clearance.

Since the safety circuit unit is yet open, when male and female terminals of both the connectors 1 and 27 are connected, the current between the male and female terminals is not applied, even when the driving lever 6 is accidentally counterclockwise rotated due to external interference so as to disconnect both the connectors 1 and 27, the operator may be kept from injury such as shock by sparks or the like.

Figure 9A:
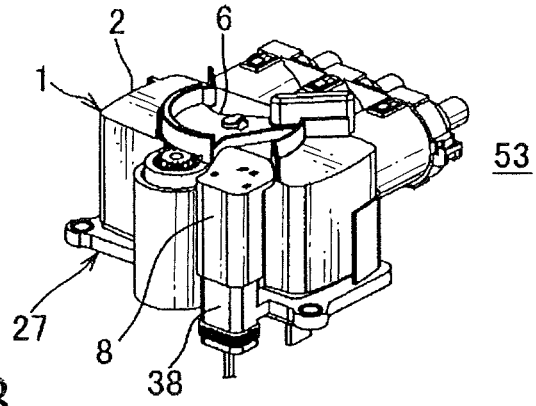
FIG. 9A is a perspective view illustrating an engagement and an electrical connection of both the connectors (a condition of)
Figure 9B:
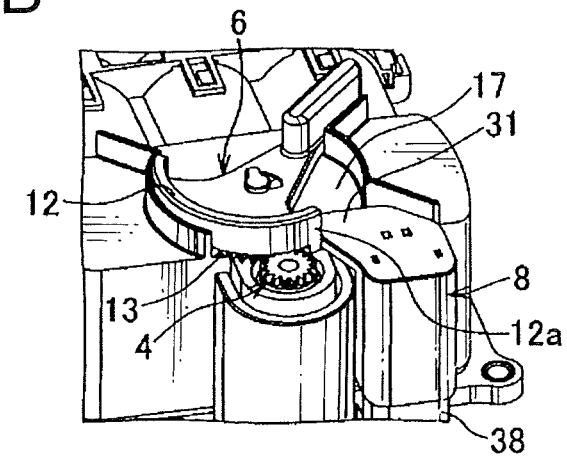
FIG. 9B is a main part perspective view illustrating an engagement and an electrical connection of both the connectors.

As shown in FIGS. 9A and 9B, pushing down the safety circuit unit 8 to connect with the small connector 3 allows a pair of terminals of the small connector 38 to be interconnected via a short terminal in the safety circuit unit 8, the safety circuit is closed, and the switch like a relay is activated such that high voltage is applied to the male and female terminals (main circuit).

The lower surface of the flange 31 of the safety circuit unit 8 abuts the upper wall 17 of the one connector housing 2, and the right sloped periphery 31*a* (FIGS. 6A, 6B) abuts the left end 12*a* of the circular-arc wall part 12 of the driving lever 6, preventing the driving lever 6 to rotate counterclockwise. Thereby, injury such as shock by sparks and the like is securely prevented when the connectors 1 and 27 are disconnected due to the driving lever 6 being rotated counterclockwise by such external interference. As far as the safety circuit unit 8 is slidably pulled up against sliding friction of the rail part 7, 25 (FIGS. 6A, 6B), the driving lever 6 cannot be rotated.

When disconnecting both the connectors 1 and 27, the operator slidably pulls up the safety circuit unit 8 against sliding friction of the rail part 7, positioning the flange 31 upper than the circular-arc wall part 12 as shown in FIGS. 8A, 8B, which thus enables the driving lever 6 to rotate counterclockwise as shown in FIGS. 7A, 7B.

FIGS. 10A to 14B show a second embodiment of a low-insertion-force connector assembly according to the present invention.

Figure 10A:
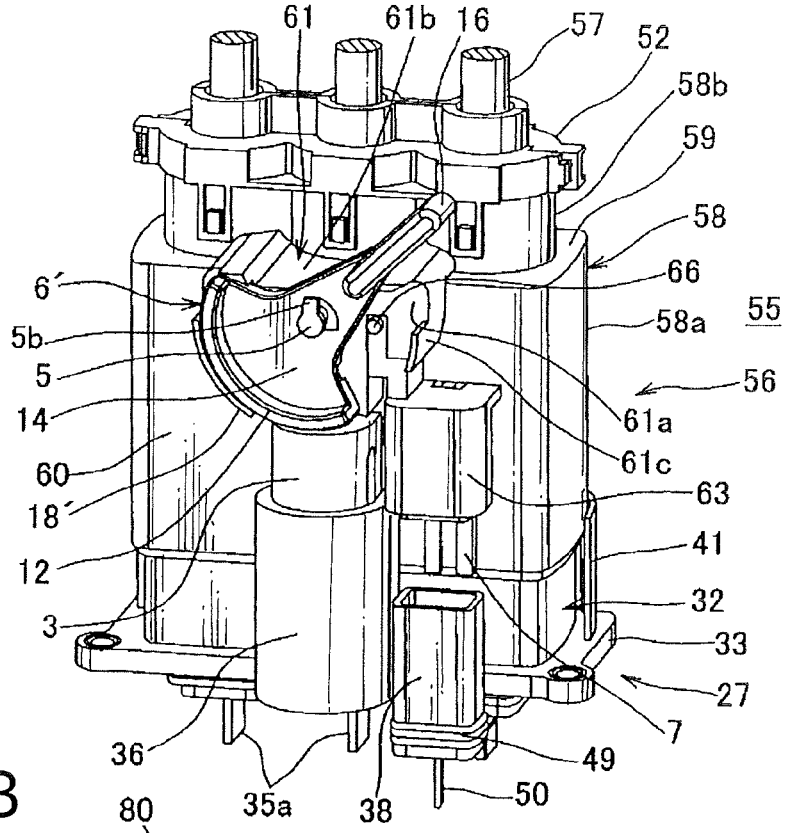
FIG. 10A is a perspective view illustrating a second embodiment of a low-insertion-force connector assembly according to the present invention.

As shown in FIG. 10A, the low-insertion-force connector assembly 55 is the one in which an electric wire 57 from one connector 56 is guided from an upper wall 59 of one connector housing 58 while conforming a pulling-out (guiding out) direction to one connector-disconnecting direction, and a driving lever 6 is pivotally supported onto a front wall 60 side of the one connector housing 58 so as to be rotatively arranged along virtual vertical face. Configuration parts that are the same as the first embodiment are marked with the same symbols to abbreviate detailed explanation.

On an upper wall 59 of a tubular part 58*a* of the one connector housing 58 made of isolating resin, a plurality of parallel integral tubular part 58*b* is disposed, an upper opening of the tubular part 58*b* is sealed by a holder 52 that is the same as the first embodiment, the electric wire 57 is guided upward from a holder 52. On the upper middle of the front wall 60 of the one connector housing 58, a bulge 61 is integrally disposed, which is composed of a vertical front wall 61 (wall part), an upper wall 61*b* of which right and left ends project upward and of which the middle portion is positioned on the same horizontal face of the upper wall 59 of the one connector housing 58, a side wall 61*c* formed in the nearly semicircle shape from the right and left to the lower side of the upper wall 61*b*.

Upward the front wall 61*a* of the bulge 61, a short columnar axis 5 is horizontally projected, which has an upward pressure projection 5*b* on the front end, and is rotatively engaged with an axis receiver hole 15 (FIG. 10B) of the driving lever 6', a vertical middle wall portion 14 is rotatively abutted to the front wall 61*a* of the bulge wall 61 therealong, and from the upper end of the bulge wall 61 an operation wall 16 is projected upward. From the side wall 61*c* of the bulge wall 61 a circular-arc guide wall 18' is projected frontward, to which a circular-arc wall 12 of the driving lever 6' is slidably abutted therealong.

Figure 10B:
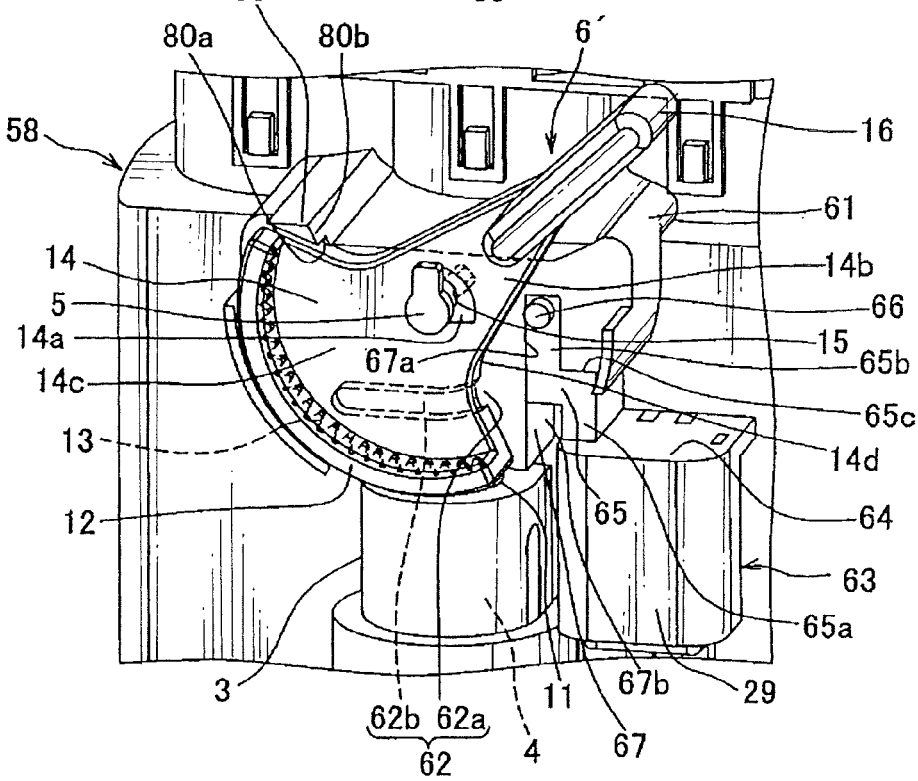
FIG. 10B is a main part perspective view in provisional engagement of both the connectors illustrating the second embodiment of a low-insertion-force connector assembly according to the present invention.

The driving lever 6', in the same manner as the first embodiment, has a nearly fan-shaped middle wall part 14, a circular-arc wall part 12 disposed under the side wall of the middle wall part 14, the operation wall 16 leading to upward the middle wall part 14, a circular-arc gear part 13 disposed on the back end of the circular-arc wall part 12 as shown in FIG. 10B, and a nearly straight groove 62 disposed on the back face (rear face) of the middle wall part 14.

The middle wall part 14 is composed of a narrow width part 14*b* and a tapered broad width part 14*a* leading to circular-arc wall part 12, the groove portion 62 has an inlet 62*a* at the adjacent area where the narrow width part 14*b* and the broad width part 14*c* cross in a left side of a side face 14*d* of the middle wall part 14, wherein the inlet 62*a* extends shortly and straightly or curvedly in a direction perpendicular to a side face 14*d* of the broad width part 14*c*, and toward the center of a circular-arc gear part 13 a long straight part 62*b* terminates short of the gear part 13 slightly curved in the dog-leg shape with the same inside width (the inlet 62*a* and the straight part 62*b* is connected crossed to each other).

The gear part 13 of the driving lever 6' is engaged with the gear wheel 11 on the top end of the gear member 4 (see FIG. 1) accommodated in a nearly half-columnar housing 3 of the one connector housing 58. Configuration and arrangement of the housing 3 and the gear member 4 is the same as the first embodiment. Since the gear part 13 and the gear wheel part 11 transmit motion between two axes thereof, it is possible to be formed, i.e., in the bevel gear shape.

As shown in FIGS. 10A, 10B, the nearly semi cylinder guide side wall 36 into which the housing 3 is inserted is vertically disposed on the middle of the one connector housing 32 made of isolating resin of the other connector 27, and leftward the guide side wall 36 the small connector 38 is adjacently disposed. Since the configuration of the other connector 27 is the same as the first embodiment, detailed explanation is abbreviated. In FIGS. 10A, 10B, the symbol 50 is shown as an electric wire connected with a pair of terminals in the small connector 38, the symbol 49 as a waterproof packing, the symbol 35*a* as a bus bar integrally leading to the male terminal 35 (see FIG. 2) in the other connector 32, the symbol 33 as a flange part, the symbol 41 as a guide wall. Each of upward and downward connectors 56, 27 is composed of each of connector housings 58, 32 and inner terminals thereof and the like, respectively.

As shown in FIGS. 10A and 10B, adjacently leftward the housing 3 of the one connector housing 58 the safety circuit unit 63 is disposed slidably along the pair of the vertical right and left rail parts 7 of the front wall 60 of the one connector housing 58, wherein the safety circuit 63 in FIGS. 10A, 10B, ascends at the upper end of the rail part 7 (upper dead point), and is halted by frictional force between the rail part 7 and a cross sectional T-shape engagement rail 25 (see FIGS. 6A, 6B) of the safety circuit unit 63. The internal configuration of the rail part 7, the engagement rail 25, and the safety circuit unit 63 are the same as the first embodiment.

The unit body (substituted by symbol 63) made of isolating resin of the safety circuit unit 63 is composed of a rectangle-tubular-shaped side wall 29 and a rectangle ceiling wall 64, wherein on the right end side of the ceiling wall 64 projection wall 65 bent crank-shaped projects upward, and on the front upper side of the projection wall 65 a short columnar boss 66 horizontally projects. Preferably the ceiling wall 64, the projection wall 65, and the boss 66 are formed by resin integral mold. The projection wall 65 is composed of a shorter vertical lower part 65*a*, a longer vertical upper part 65*b* and upper part boss 66, and the lower part 65*a* and upper part 65*b* are connected via a horizontal step face 65*c*.

On the bulge wall 61 of the one connector housing 58 a vertical groove 67 receiving the projection wall 65 of the safety circuit unit 63. The groove 67 is composed of a narrow upper part 67*a* and a broad lower part 67*b*, wherein the lower part 67*b* is opened to a leftward side wall face 61*c* of the bulge wall 65, the upper part 65*b* of the projection wall 65 is inserted into the upper part 67*b* of the groove 67, the lower part 65*a* of the projection wall 65 is inserted into the lower part 67*b* of the groove 67, the upper end of the upper part 65*b* abuts the upper end of the groove part 67, and the step face 65*c* abuts the step face of the groove 67. The front face of the projection wall 65 is positioned the same face vertical to the front face 61*a* of the bulge wall 61.

In a state of the projection wall 65 being wholly inserted into the groove part 67 as shown in FIGS. 10A, 10B, the boss 66 is positioned on a rotation track of the inlet end (substituted by 62*a*) of the groove 62 of the driving lever 6'. The projection wall 65 is formed in the crank shape so as to engage the boss 66 with the groove 62, and the projection wall 65 may be straight as far as the boss 66 can be engaged with the groove 62.

FIGS. 10A, 10B show provisional (initial) connection state of both the upper and lower connectors 56, 27, i.e., the state that male and female terminals in both the upper and lower connectors 56, 27 are disconnected, wherein the driving lever 6' slants the operation wall part 61 thereof leftward, the circular-arc wall part 12 is positioned rightward the bulge wall 61 together with the gear part 13 thereof, and the left end of the gear part 13 is engaged with the gear wheel 11 of the top of the gear member 4 in the housing 3. On the right top side of the bulge wall 61 a stopper wall 80 corresponding to the driving lever 6' projects frontward, a slant lower face 80 of which is abutted by the right end face of the broad part 14*c* of the middle wall part 14 of the driving lever 6' so as to prevent the driving lever 6' from rotating leftward further. It is noted that "right" herein is not right viewing frontward but viewing backward. The safety unit 63 and the small connector 38 are widely, vertically separated in FIGS. 10A, 10B.

Figure 11A:
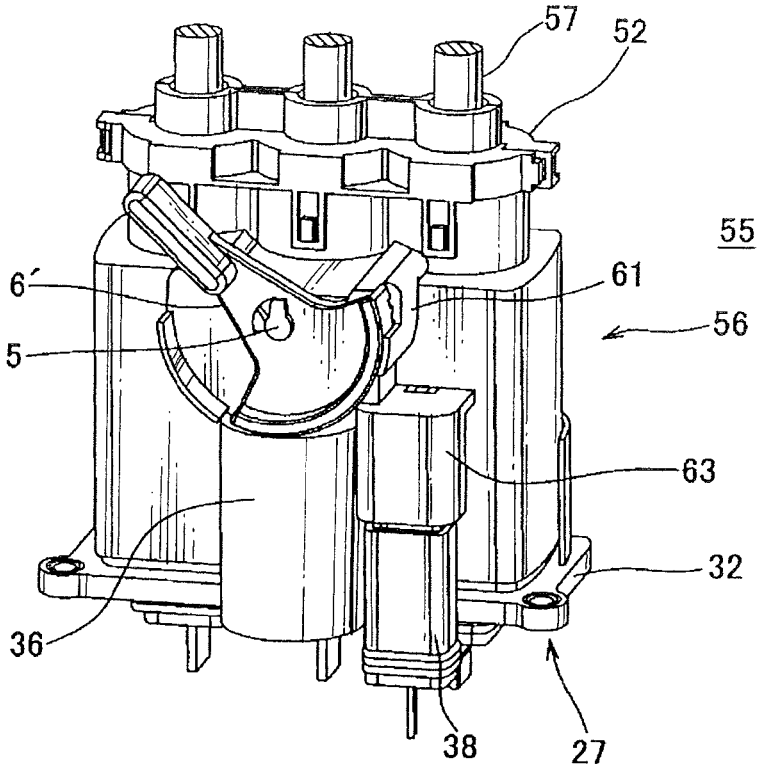
FIG. 11A is a perspective view illustrating an engagement state of both the connectors (the state of an electrical disconnection)
Figure 11B:
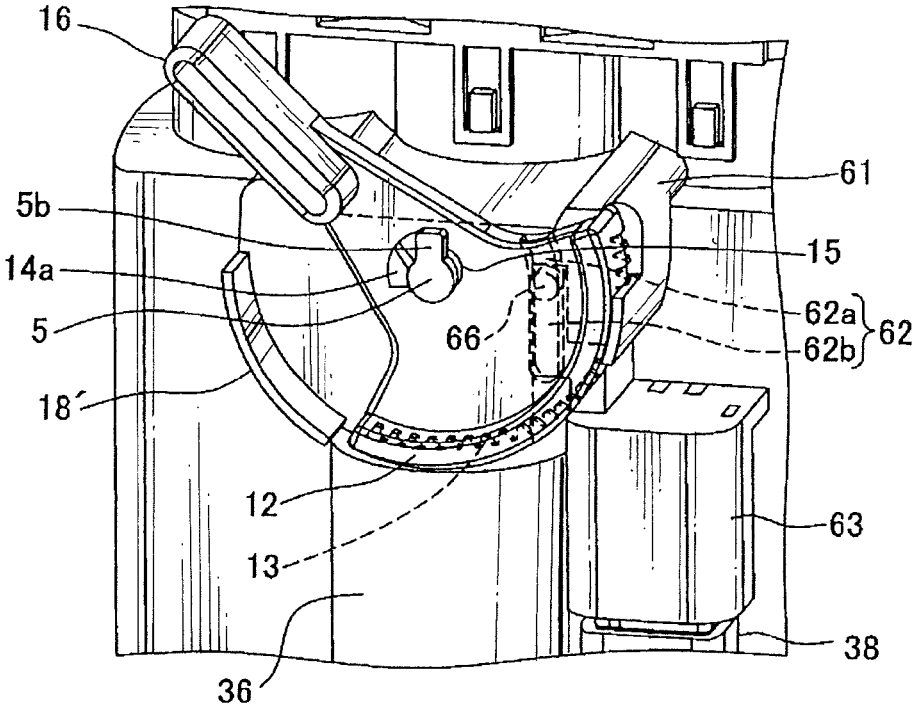
FIG. 11B is a main part perspective view illustrating the engagement state of both the connectors.

The operator, from the state in FIGS. 10A, 10B, rotates rightward the operation wall part 16 of the driving lever 6' as shown in FIGS. 11A, 11B, the boss 66 of the safety circuit unit 63 is thus positioned approaching the upper of the vertical long straight part 62*b* via the short inlet part 62*a* from the inlet end of the groove part 62 of the driving lever 6' as shown in FIG. 11B. The long straight part 62*b* is vertically positioned parallel to the rail part 7, and the inlet part 62*a* is positioned aslope slightly rightward. The inlet part 62*a* is formed slope or bent so as to receive smoothly the boss 66 along the rotation track of the driving lever 6'. The right end side of the narrow part 14*b* of the middle wall part 14 (FIGS. 10A, 10B) of the driving lever 6' abuts a slant face 80*b* leftward the stopper 80 (FIGS. 10A, 10B) so as to prevent the driving lever 6' from rotating rightward further. The operation wall part 16 of the driving lever 6' is slanted rightward, and the circular-arc wall part 12 is positioned leftward the bulge 61 together with the gear part 13.

As shown in FIG. 11A, Rotation of the driving lever 6' allows the gear member 4 to rotate (see FIG. 3), the driven projection 37 (see FIG. 2) of the other connector housing 32 approaches and is engaged along the spiral groove 10 (FIG. 3) of the gear member 4, and the other connector 27 is pulled in by the one connector 56 and engaged such that the male and female terminals in both the connectors 27, 56 are connected. Because the safety circuit unit 63 and the small connector 38 are disconnected, the main circuit including the male and female terminals is not energized. This is the same as the first embodiment.

Figure 12A:
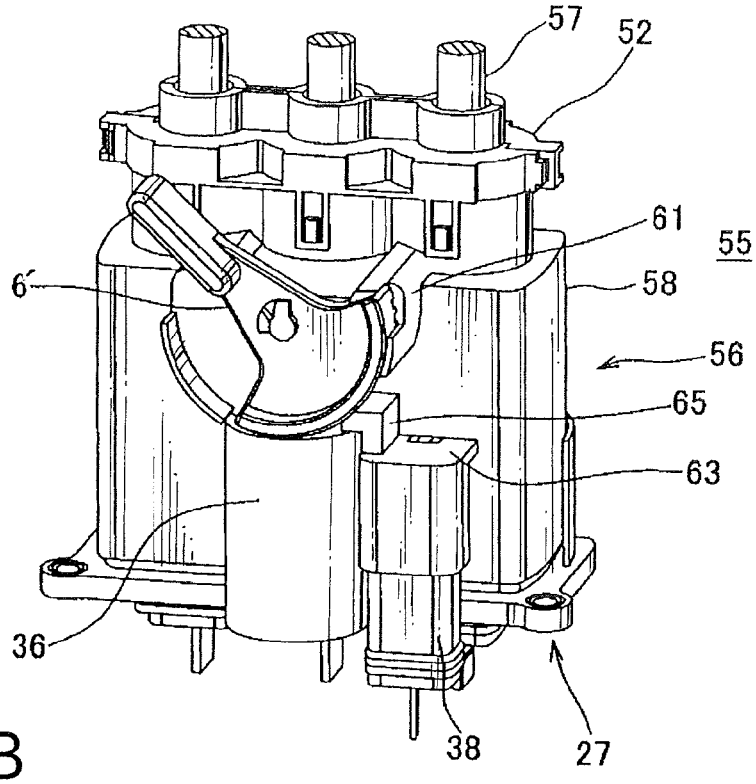
FIG. 12A is a perspective view illustrating an engagement and an electrical connection of both the connectors.
Figure 12B:
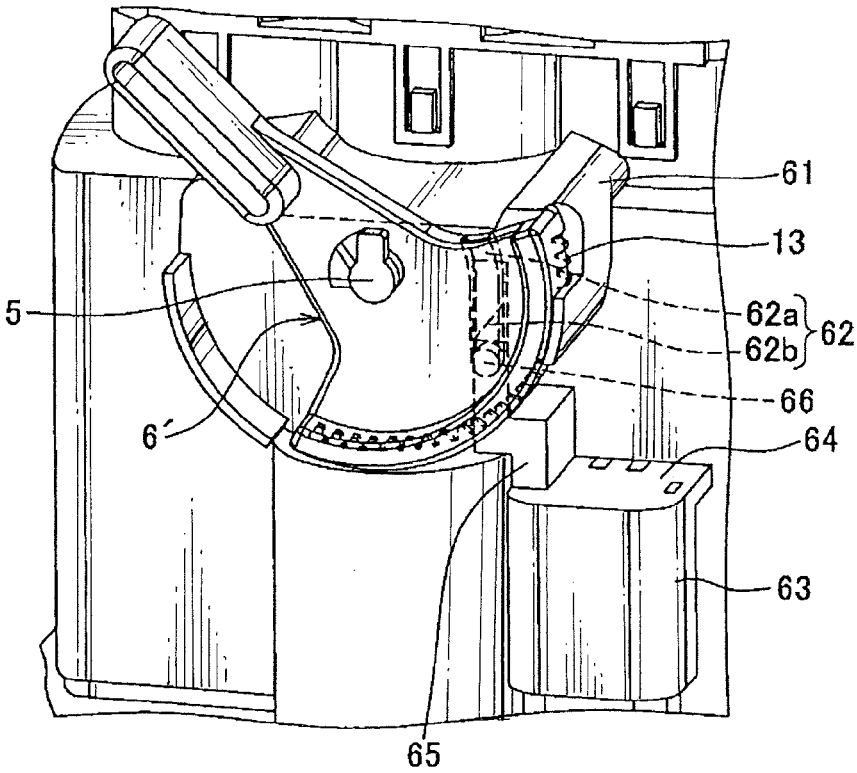
FIG. 12B is a main part perspective view illustrating the engagement and an electrical connection of both the connectors.

As shown in FIGS. 12A and 12B, pushing down, from the one connector engaging state in FIGS. 11A, 11B, the safety circuit unit 63 along the rail part 7 (FIGS. 10A, 10B) so as to engage with the small connector 38 of the other connector 27, and the U-shaped short terminal in the safety circuit unit 63 shunts the pair of right and left terminals in the small connector 38, energizing the safety circuit (main circuit), the main circuit being thus energized.

The operation of pushing down the safety circuit unit 63 is performed, e.g., by pushing downward the ceiling wall 64. Along the downward vertical groove 62 of the driving lever 6' in FIGS. 11B and 12B, the boss 66 of the projection wall 65 of the safety circuit unit 63 slides downward. The projection wall 65 having the boss 66 integrally descends along the groove 67 of the bulge 61 of the one connector housing 58. The driving lever 6' remains not to be rotated.

When the engagement of both the connectors 27, 56 is insufficient, pushing down the safety circuit unit 63 allows the driving lever 6' to be driven by the boss 66 and to rotate in the engaging direction of both the connectors 27, 56, thus both the connectors being wholly connected.

The moving track of the boss 66 and the sliding track of the safety circuit unit 63 are the same direction and parallel. The boss 66 abuts the lower end of the groove 62 of the driving lever 6'. Because the boss 66 engages with the groove 62, the driving lever 6' is prohibited to rotate, which prevents unexpected disconnection (separation) of both the connectors 27, 56, and hazard such as shock. The boss 66 operates as a rotation stopper against the driving lever 6'.

When disconnecting both the connectors 27, 56, the safety circuit unit 63 is pulled up along the rail part 7 (FIGS. 10A, 10B) from the state in FIGS. 12A, 12B to disconnect the small connector 38. The boss 66 ascends along the groove part 62 to be in the state shown in FIGS. 11A, 11B. In this state the safety circuit is powered off and the main circuit is cut off, the operator can thus rotate the driving lever 6' (operation of the operation wall part 16 being laid leftward as shown in FIGS. 10A, 10B) without fear of such shock so as to separate both the connectors 27, 56, disconnecting safely both male and female terminals. In association with rotation of the driving lever 6' from the state in FIGS. 11A, 11B, the boss 66 smoothly, slidably contact with the inlet 62*a* formed slope or bent from the straight part 62*b* of the groove 62 while separating outward from the inlet part 62*a* as shown in FIGS. 10A, 10B.

Figure 13:
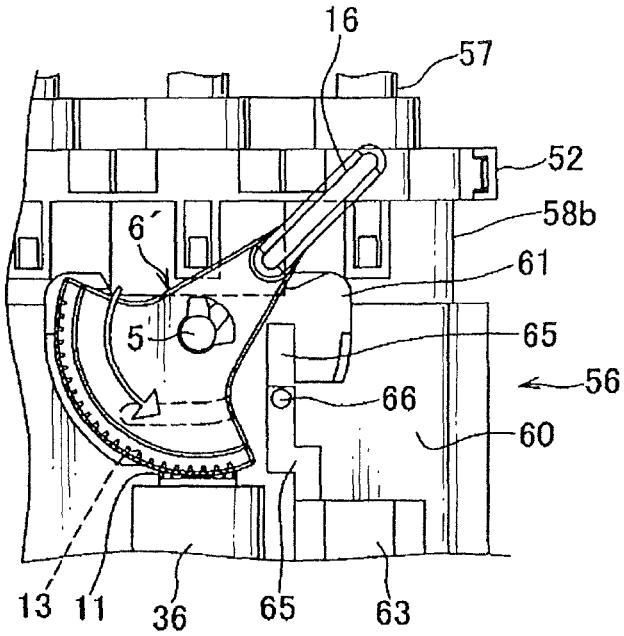
FIG. 13 is A front view illustrating a condition in which a safety circuit unit is connected in provisional connection.
Figure 14A:
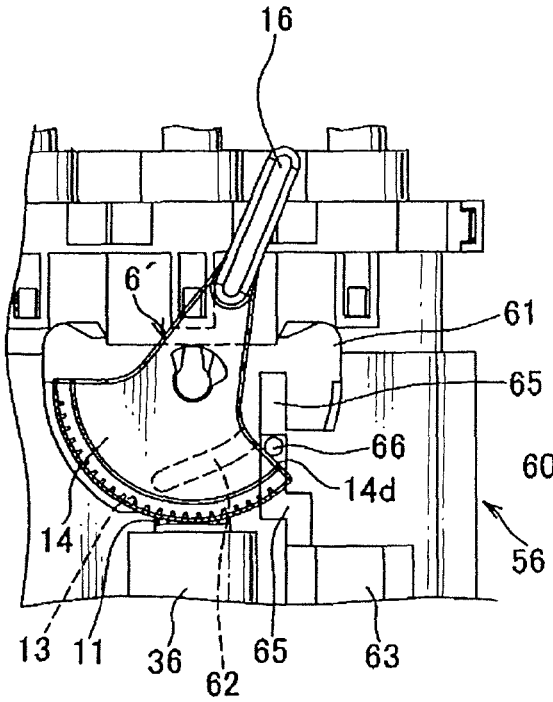
FIG. 14A is a front view illustrating a state in which a driving lever is rotated in a connecting direction.
Figure 14B:
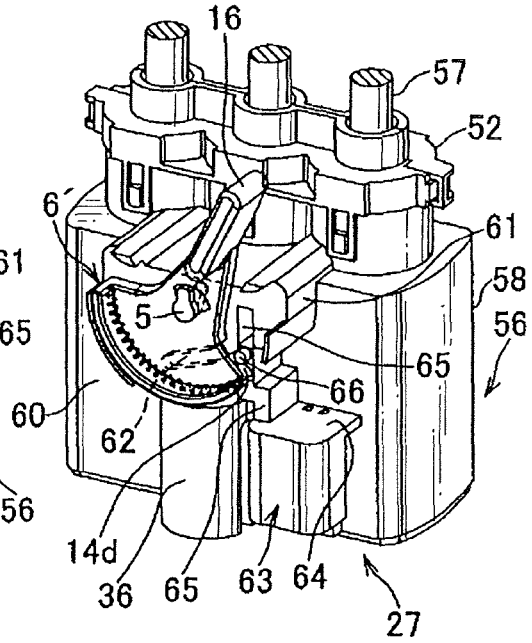
FIG. 14B is a perspective view illustrating a state in which a driving lever is rotated in a connecting direction.
Figure 15:
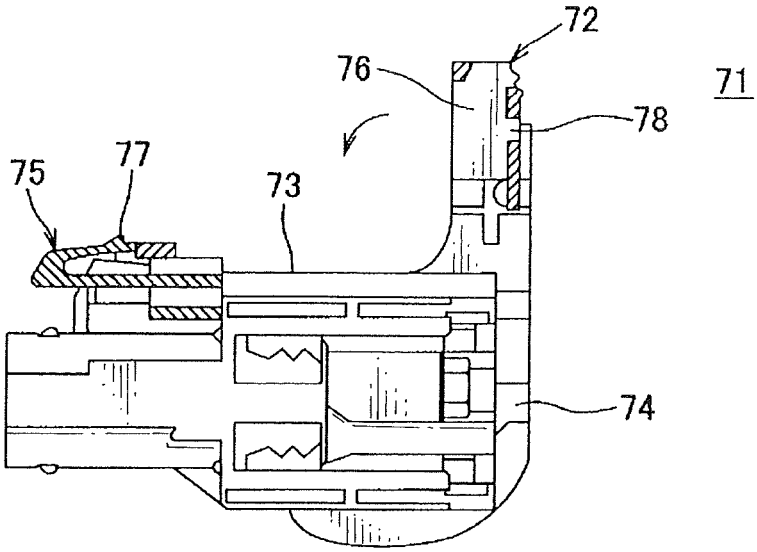
FIG. 15 PRIOR ART
FIG. 15 is a longitudinal sectional view illustrating one embodiment of a conventional low-insertion-force connector assembly (wherein hatched parts on other than main parts are omitted).

FIG. 13 shows a state in which the safety circuit unit 63 is down along the rail part 7 (FIGS. 10A, 10B) with both the connectors 27, 56 in provisional connection shown in FIGS. 10A, 10B, wherein because the boss 66 is also down along the groove 65 of the bulge wall 61 together with the projection wall 65, when rotating rightward the operation wall part 16 of the driving lever 6' as shown in FIGS. 14A, 14B (rotating counterclockwise the driving lever 6' viewed from the front as shown by the arrow in FIG. 13), the left side face 14*d* of the fan-shaped middle wall part 14 of the driving lever 6' abuts the boss 66 to prevent insertion of the boss 66 into the groove 62, and further rotation of the driving lever 6', disabling connection of both the connectors 27, 56. The operator finds this state, ascending the safety circuit unit 63, arranging the boss 66 to the regular position shown in FIGS. 10A, 10B, from the state thus restarting connection operation.

Although the safety circuit unit 63 in FIG. 13 is connected with the small connector 38 at the down position so as to energize the main circuit, the terminals in both the connectors 27, 56 are secure against exposure outward because both connectors are supported without being separated by the engaging force of the safety circuit unit 63 and the small connector 38.

It is noted that although the boss 66 is provided with the safety circuit unit 63 via the projection wall 65 in the above second embodiment, the boss 66 may be directly mounted to the box-shaped safety circuit unit body 63 precluding the projection wall 65 in case of setting the ascension position of the safety circuit unit 63 higher than that in FIGS. 10A, 10B. Further precluding the bulge wall 61 of the one connector housing 58, the driving lever 6' can be rotatively supported onto the front wall 60 of the one connector housing 58 directly so as to engage with the groove 62 disposed frontward instead of backward.

The low-insertion-force connector assembly according to the invention can be utilized in a narrow space in an electric vehicle including a hybrid car so as to insert and connect male and female connectors with ease and low force as well as to prevent hazard such as spark upon connection or disconnection of both the connectors.

REFERENCE SIGNS LIST

1,56 one connector
4 gear member
5 axis part
6,6' driving lever
8,63 safety circuit unit
10 spiral groove
11 gear wheel part
12 circular-arc wall part
13 gear part
14 operation part
16 guide section
17 upper wall (wall part)
27 mating connector
31 flange part
35 male terminal
37 driven projection
38 small connector
53,55 low-insertion-force connector assembly
61*a* front wall (wall part)

The invention claimed is:

1. A low-insertion-force connector assembly comprising:
one connector receiving one terminal; and
the other connector receiving a mating terminal,
the one connector including:
a driving lever having a gear part arranged in a circular-arc shape, rotatively arranged along a wall portion of the one connector, and pivotally supported onto the wall portion,
a gear wheel engaging with the gear part; and
a gear member having a spiral groove engaged with a driven projection of the other connector.

2. The low-insertion-force connector assembly as claimed in claim 1, wherein the driving lever comprises a circular-arc-shaped wall part having the gear part, a pivotally-supported middle wall part, and an operation part.

3. The low-insertion-force connector assembly as claimed in claim 1, wherein the one connector is provided with a safety circuit unit slidable in an axial direction of the driving lever, wherein the other connector is provided with a small connector for connecting with the safety circuit unit,
wherein the driving lever prevents the safety circuit unit from moving in a connecting direction at a provisional connector-engaging position, and wherein the driving lever permits the safety circuit unit to move in the connecting direction and is prevented from rotating by a flange of the safety circuit unit at a connector-engaging position.

4. The low-insertion-force connector assembly as claimed in claim 1, wherein the one connector is provided with the safety circuit unit slidable in a direction axially perpendicular to the driving lever, wherein the other connector is provided with a small connector for connecting with the safety circuit unit, and wherein the driving lever includes a groove engaged with a boss of the safety circuit unit, wherein the boss is approached to engage with the groove by rotation of the driving lever in a state of disconnection between the safety circuit unit and the small connector, and wherein the groove corresponds to a sliding direction thereof so that the safety circuit unit operatively connects with the small connector in a state of connection between both the connectors while both the connectors are engaged with each other.

5. The low-insertion-force connector assembly as claimed in claim 4, wherein the boss of the safety circuit unit disengaged with the small connector abuts a side where the groove of the driving lever is formed such that the driving lever is prohibited to rotate in an engaging direction of both the connectors.

6. The low-insertion-force connector assembly as claimed in claim 2, wherein the one connector is provided with a safety circuit unit slidable in an axial direction of the driving lever, wherein the other connector is provided with a small connector for connecting with the safety circuit unit, wherein the driving lever prevents the safety circuit unit from moving in a connecting direction at a provisional connector-engaging position, and wherein the driving lever permits the safety circuit unit to move in the connecting direction and is prevented from rotating by a flange of the safety circuit unit at a connector-engaging position.

7. The low-insertion-force connector assembly as claimed in claim 2, wherein the one connector is provided with the safety circuit unit slidable in a direction axially perpendicular to the driving lever, wherein the other connector is provided with a small connector for connecting with the safety circuit unit, and wherein the driving lever includes a groove engaged with a boss of the safety circuit unit, wherein the boss is approached to engage with the groove by rotation of the driving lever in a state of disconnection between the safety circuit unit and the small connector, and wherein the groove corresponds to a sliding direction thereof so that the safety circuit unit operatively connects with the small connector in a state of connection between both the connectors while both the connectors are engaged with each other.

8. The low-insertion-force connector assembly as claimed in claim 7, wherein the boss of the safety circuit unit disengaged with the small connector abuts a side where the groove of the driving lever is formed such that the driving lever is prohibited to rotate in an engaging direction of both the connectors.

9. The low-insertion-force connector assembly as claimed in claim 1, wherein the driving lever is rotated on one plane along the wall portion.

* * * * *